United States Patent [19]

Armstrong et al.

[11] 4,365,701

[45] Dec. 28, 1982

[54] NEWSPAPER VENDING MACHINE

[76] Inventors: Currie Armstrong; Clarence E. Christophersen, both of 255 W. Torrance Blvd., Carson, Calif. 90745

[21] Appl. No.: 234,981

[22] Filed: Feb. 17, 1981

[51] Int. Cl.[3] ..... G07F 11/28

[52] U.S. Cl. ..... 194/22; 221/289

[58] Field of Search ..... 221/289, 290, 293, 251, 221/91; 194/37, 68, 22

[56] References Cited

U.S. PATENT DOCUMENTS 517,412 3/1894 Martel ..... 221/91

*Primary Examiner*—Stanley H. Tollberg

*Attorney, Agent, or Firm*—Georges A. Maxwell

[57] ABSTRACT

A coin-operated newspaper vending machine comprising a cabinet with a lower forwardly opening discharge opening and a flat forwardly and upwardly inclined support plate in the cabinet space above and rearward of the opening, a vertical stack of newspapers supported atop the plate, an elongate vertical stop post in the cabinet forward of the plate and engaging and stopping forward downward movement of the newspapers, manually operable drive operable to move the post down and out of engagement with the newspapers above the plate one at a time, a latch mechanism locking the drive each time a newspaper moves from above the plate and a coin mechanism to release the latch mechanism.

8 Claims, 11 Drawing Figures

2
5
4
M
A
N
P
S
Z
C
D
I
X
10
11
12
13
15
16
17
18
19
22
23
24
25
26
27
28
29
30
31
32
33
34
35
36
37
38
39
43
46
50'
65
66
67
69
75
78
84

NEWSPAPER VENDING MACHINE

This invention has to do with coin-operated vending machines and is particularly concerned with a novel coin-operated newspaper vending machine.

BACKGROUND OF THE INVENTION

Throughout the country, it is common practice for newspaper publishers and distributors to sell newspapers by means of coin-operated vending machines strategically located adjacent store fronts, street corners and the like.

The most common form or type of newspaper vending machine consists of a box-like cabinet in which a supply of newspapers can be deposited, in stacked relationship, and which has an access opening at one side. The access opening is normally closed by a manually operable hinged door or closure. The closure is normally releasably latched in closed position by a coin-operated latching device.

To purchase a newspaper from such vending machines, a purchaser deposits necessary coinage in the machine to effect unlatching of the door. Thereafter, he manually opens the door and manually engages and removes a newspaper from the stack of newspapers stored within the machine. Having obtained his newspaper, the purchaser releases the door. The door automatically closes and is relatched, preparatory for recycling by the next purchaser.

The principal or major shortcoming in the above noted common form of newspaper vending machine resides in the fact that any purchaser can, upon depositing required coinage for one newspaper, remove the entire supply of newspapers and sell the misappropriated newspapers for personal economic gain or remove the entire supply of newspapers to remove and collect various coupons published therein and which are tradable for merchandise, cash refunds and the like.

One major newspaper, the Los Angeles Times, owns and operates about 5,000 vending machines of the character referred to above. It is further understood that the Los Angeles Times has determined that theft of newspapers from those machines results in a loss of revenue amounting to nearly 3 million dollars each year.

In the past, the prior art has sought to provide more sophisticated theft-proof coin-operated newspaper vending machines which are such that free access to the supply of papers is not afforded and machines which are such that upon the depositing of appropriate coinage, a single newspaper is dispensed.

While certain of the more sophisticated and theft-proof forms of newspaper vending machines alluded to above have met with some success, each has proven to be wanting in one way or another.

As the art of newspaper vending machines has developed and the shortcomings of old machines have been overcome by improvements, the machines have become notably more costly and complicated to make, maintain and to service. As a result of the foregoing, the capital investment and the cost of maintenance and service of those theft-proof vending machines provided by the prior art, which might be serviceable and dependable in use, exceeds or is so close to the losses experienced in the use of the first noted non-theft-proof or common form of newspaper vending machine that adoption and use of the more sophisticated machines is not economically practical.

The major problems encountered in the handling and dispensing of newspaper machines in coin-operated newspaper vending machines are the result of or caused by the fact that newspapers are rather loosely laminated and softly folded bodies of rather weak and fragile newsprint (paper) and are thereby so weak, fragile and dimensionally unstable that most forms of dispensing mechanisms found in the art of vending machines tend to mutilate newspapers and/or are easily fouled by the newsprint. Further, newspapers are subject to wide differentials in thickness and weight and are such that most dispensing mechanisms provided by the prior art of vending machines would have to be carefully and accurately adjusted and set to effectively handle each new edition of the newspaper dispensed thereby. Finally, most newspapers print and publish regular weekday editions which sell for one price and print and publish Sunday editions and other special editions which sell for a different price. Accordingly, a newspaper vending machine, to be truly effective and practical in use, must be such that it can be easily and quickly adjusted and set to receive and to be operated by different coinage.

OBJECTS AND FEATURES OF THE INVENTION

An object and feature of this invention is to provide a novel and extremely inexpensive coin-operated newspaper vending machine in which a supply of newspapers can be safely stored and which operates to dispense newspapers stored therein one at a time.

Another object and feature of this invention is to provide a vending machine of the general character referred to above which is unaffected by the thickness and weight of the newspapers deposited therein and dispensed thereby and is such that it will effectively dispense newspapers of different thickness and weight, one at a time, without the necessity of adjusting or otherwise working on the machine.

It is another object and feature of the invention to provide a newspaper vending machine of the general character referred to above which has a novel, simple and inexpensive to make coin mechanism which can be easily and quickly adjusted and set to receive different coinage, as desired or as circumstances require.

Still another object and feature of this invention is to provide a coin-operated newspaper vending machine of the character referred to in the foregoing wherein a supply of newspapers is supported in vertical stacked relationship and on forwardly and downwardly inclined planes whereby each upper newspaper will slide forwardly and downwardly relative to and from engagement with each adjacent lower newspaper and a machine which includes a vertically shiftable stop normally engaging the lower front edges of the stacked newspapers and which is intermittently shiftable downwardly from engagement with the uppermost newspaper on the stack of newspapers whereby said uppermost newspaper is free to slide forwardly and downwardly from engagement atop the stack of newspapers and thence from the machine.

It is an object and feature of this invention to provide a simple manually operable drive means which is intermittently operable to move said stop means downwardly from engagement with the top newspaper of the stacked supply of newspapers in the machine and which includes novel latch means normally set to stop operation of the drive means.

It is an object and feature of this invention to provide a novel latch means for the drive means which is released by the coin mechanism and which is reset by a newspaper advancing forwardly and downwardly from the stack of newspapers.

Finally, it is an object and feature of this invention to provide a novel coin-operated newspaper vending machine of the general character referred to above which is rugged and durable, extremely easy to service and maintain and which is highly effective and dependable in operation.

The foregoing and other objects and features of this invention will be apparent and will be fully understood from the following detailed description of a typical preferred form of the invention throughout which description reference is made to the accompanying drawings.

DETAILED DESCRIPTION OF THE INVENTION

Figures 1, 2, 3, 4:
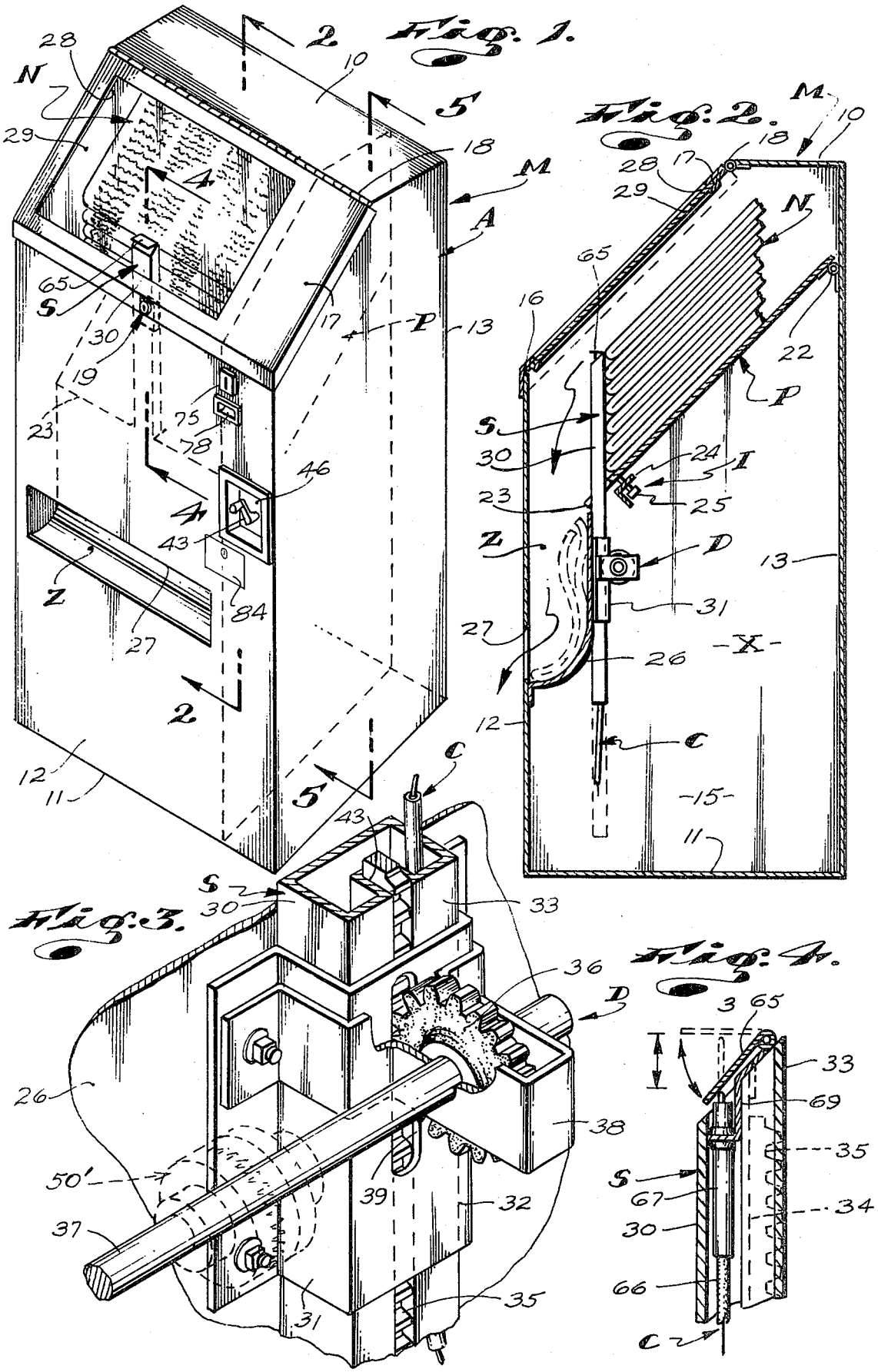
FIG. 1 is an isometric view of the newspaper vending machine embodying our invention.
FIG. 2 is a sectional view taken substantially as indicated by line 2—2 in FIG. 1.
FIG. 3 is an isometric view of a portion of the structure shown in FIG. 2.
FIG. 4 is an enlarged sectional view taken as indicated by line 4—4 in FIG. 1.

The newspaper vending machine M that we provide is shown as including a simple box-like cabinet A with flat horizontal top and bottom walls 10 and 11, flat vertical front and rear walls 12 and 13 and opposite left and right hand side walls 14 and 15. The upper forward, transversely extending corner portion of the cabinet is truncated or cut off at an angle of about 45° to define a forwardly and upwardly disposed transverse access opening 16. The opening 16 is normally closed by a flat rearwardly and upwardly inclined, forwardly and upwardly disposed closure or door 17. The upper rear edge of the door 17 is hinged with the forward edge of the top wall 10, as indicated at 18, and the lower forward edge of the door is normally releasably latched to the upper edge portion of the front wall 12 by a key operated latch mechanism, diagrammatically shown at 19 in FIG. 1 of the drawings.

In addition to the foregoing, the cabinet A includes a flat vertical partition 20 in spaced parallel relationship with and between the side walls 14 and 15 and cooperating with the side wall 15 to define a compartment X and cooperating with the side wall 14 to define a compartment Y. Both compartments X and Y are accessible through the access opening 16 when the door 17 is opened, that is, when the latch 19 is released and the door is pivoted upwardly and rearwardly about its pivotal axis.

The machine M next includes a flat, smooth forwardly and upwardly disposed, rearwardly and upwardly inclined newspaper support plate P positioned within the upper portion of the compartment X. The plate P is larger in plan configuration than newspapers N which it serves to support. The plate P has a transversely extending upper rear edge which can be fixed to the rear wall 13 but which is preferably pivotally secured to the wall 13 by hinge means 22. The plate P has a transversely extending lower front edge 23 which is spaced rearward from the front wall 12 of the cabinet a distance sufficiently great to allow for the free downward movement of newspapers N (moving forwardly from engagement above the plate) between the plate P and the front wall 12.

The lower front portion of the plate P is preferably supported by vertically adjustable plate support means E which, as shown in FIG. 2 of the drawings, includes a transversely extending beam 24 in the chamber X below the plate P and one or two substantially vertically extending screw or bolt-like posts 25 threadedly engaged through the beam and engaging the tower surface plate P whereby the vertical positioning of the lower front portion of the plate and the resulting angular disposition of that plate can be adjusted by vertical adjustment of said posts.

The plate P is disposed at an angle of about 45° (angle of shear) so that newspapers N positioned above and supported by the plate are at the same angle and will, in the absence of some retaining or stopping means, slide forwardly and downwardly relative to the plate and relative to each other. Since the coefficient of friction of newspapers with each other and with the plate P is subject to notable variations, the angle of the plate may have to be adjusted from time to time to assure proper operation of the machine. Such adjustment can be easily and conveniently made by operation of the above noted plate support means E.

The plate P supports and carries a stack of standard multi-page loosely laminated and softly folded newspapers N. It is only necessary that the newspapers N be arranged above the plate P with their outside folded edges extending transverse the front of the stack of newspapers, as clearly shown in FIG. 2 of the drawings.

The cabinet A next includes a panel 26 in the chamber X below the plate P and spaced rearward from the front wall 12 and cooperating with the wall 12 to define a vertical discharge chute Z, through which newspapers moved forwardly from engagement above the plate P can drop freely. The panel 26 has a flat, vertical, transversley extending upper portion in spaced parallel relationship from the front wall 12 and has a downwardly and forwardly turned lower portion which engages and stops at the front wall 12 immediately below an elongate, horizontal and transversely extending discharge opening 27 in the front wall 12 and through which free manual access is had to newspapers dropped down through the discharge chute Z.

In the preferred form and carrying out of our invention, the portion of the door or closure 17 overlying the opening 16 at the upper forward portion of the compartment X is provided with a window opening 28 having a transparent windowpane 29 set therein so that visual inspection of the interior of the compartment, and of the newspapers N supported by the plate, can be made by prospective purchasers of the newspapers.

The machine M next includes vertically shiftable stop means S to engage the lower front or folded edge portions of each newspaper N stacked above and supported by the support plate P. The stop means S serves to prevent the newspapers N from shifting forwardly and downwardly from above the plate P and thence down through the discharge chute Z.

A stop means S is shiftable downwardly relative to the plate P and out of engagement with the newspapers N, whereby the newspapers are released by the stop means and are let to slide forwardly and downwardly relative to the plate P and to thereafter drop freely downwardly through the discharge chute Z.

By controlled shifting of the stop means S, the newspapers N stacked and supported in the machine above the plate P can be effectively discharged from the machine one at a time by intermittently moving the stop means down a distance sufficient to disengage the uppermost newspaper of the stack of newspapers.

In the form of the invention illustrated, the stop means S includes an elongate vertical stop post 30 arranged in the compartment X substantially midway between the opposite sides thereof and adjacent that vertical plane on which the lower forward folded edges of the newspaper N stacked above the support plate P occur. The post 30 is supported by a guide means 31, which guide means supports the post against lateral and/or angular displacement and yet allows for free vertical shifting thereof. The guide means 31 is shown as including a flanged channel section 32 suitably fastened to the rearwardly disposed side or surface of the panel 26 and cooperating therewith to define an elongate vertical guideway in and through which the post 30 is slidably engaged.

In the form of the invention illustrated, the post 30 occurs rearward of and between the ends of the lower forward edge of the plate P. Accordingly, the plate P is suitably notched to freely accommodate the post, as shown in FIG. 2 of the drawings.

The post 30 can vary widely in construction and, for the purpose of this disclosure, is shown as an elongate vertical box section of extruded aluminum or the like. The section defines the flat, vertical rearwardly disposed stop surface 33 with an elongate vertical rearwardly opening channel 34. An elongate, vertical rearwardly disposed rack 35 is arranged and suitably fixed in the channel 34. The rack 35 is a part of a manually operable drive means D provided to move the post vertically.

The drive means D, in addition to the noted rack 35, includes a drive gear 36 engaging the rack and carried by an output shaft 37 extending transversely through the cabinet from within the compartment Y, through an opening (not shown) in the partition 20, and into the compartment X. The shaft 37 and the gear 36 occur rearward of the guide means 31. The shaft 37 is rotatably supported by a bracket 38 adjacent the guide means 31 for the stop post 30 and the channel section 32 of the guide means 31 is provided with a slot opening 39 to accommodate that portion of the gear which is engaged with the rack 35, as clearly shown in FIG. 3 of the drawings.

With the structure thus far described, it will be apparent that upon rotation of the output shaft 37 and drive gear 36, by yet to be described elements and parts of the drive means D, the stop post 30 can be shifted vertically as desired and as circumstances require.

In practice, the upper portion of the post 30 is coextensive with the vertical extent of the stack of newspapers N supported by the plate P and is such that its upper terminal end portion engages the center of the lower forward and folded edge of the top or uppermost newspaper. When it is desired that a newspaper be dispensed from the machine, the post 30 is driven down by the means D so that the noted upper terminal end portion of the post disengages the upper or top newspaper and allows that newspaper to slide forwardly and downwardly from the stack of newspapers, over the top of the post 30 and thence down through the discharge chute Z. The next lowered newspaper then becomes the top or uppermost newspaper in the stack of newspapers and is retained by the post 30 until the post 30 is again lowered to effect discharge of that top newspaper, in the same manner as is described above.

Figure 5:
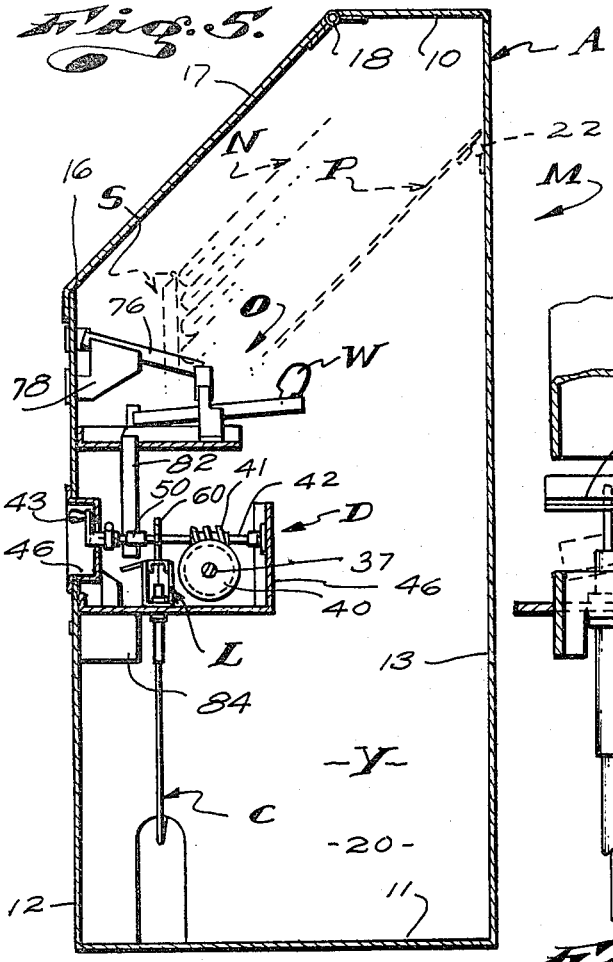
FIG. 5 is a sectional view taken substantially as indicated by line 5—5 in FIG. 1.
Figure 7:
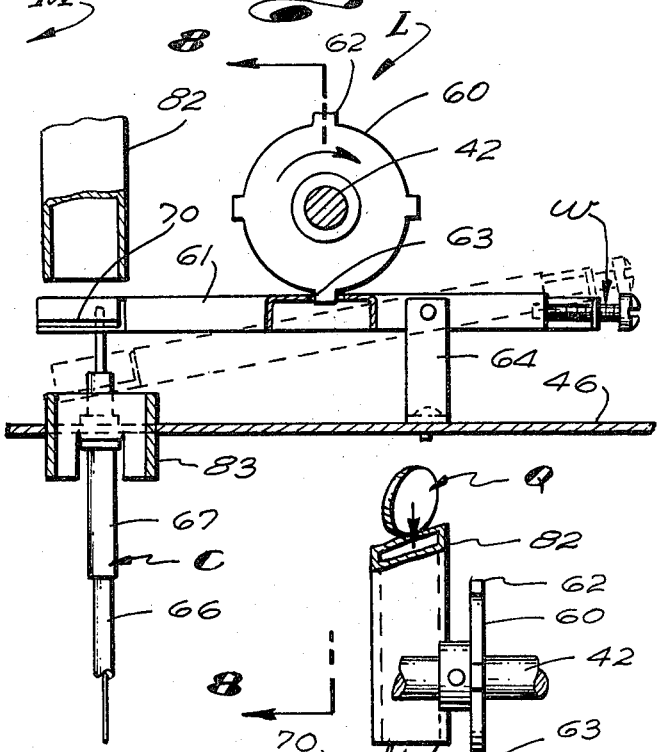
FIG. 7 is a view taken substantially as indicated by line 7—7 in FIG. 6.
Figure 8:
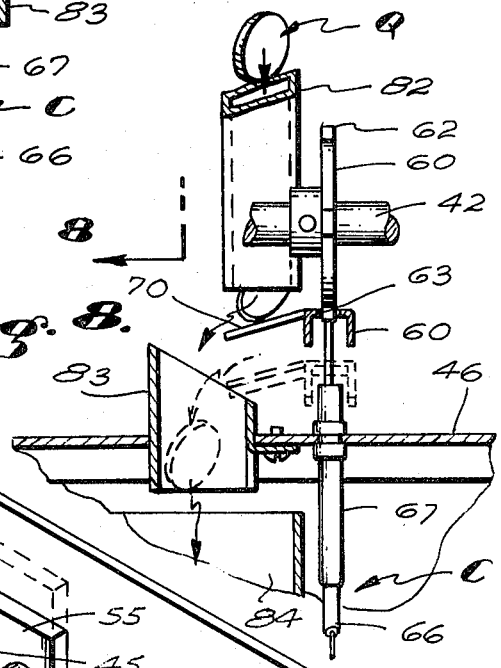
FIG. 8 is a view taken substantially as indicated by line 8—8 in FIG. 7.
Figure 6:
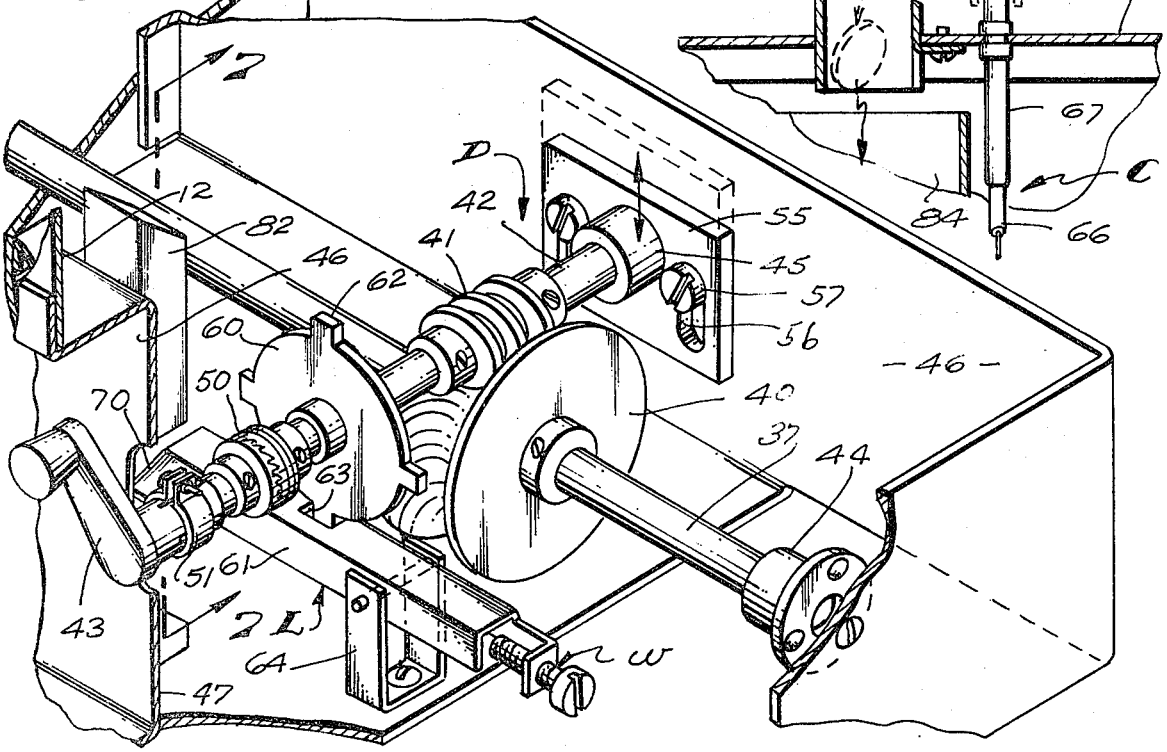
FIG. 6 is an isometric view of a portion of the structure shown in FIG. 5.

Referring to FIGS. 5 and 6 of the drawings, the drive means D next includes a driven gear 40 on the portion of the output shaft 37 which extends into the compartment Y of the cabinet A. The driven gear 40 is engaged by a worm gear 41 carried by an input shaft 42. The input shaft 42 occurs in spaced relationship above and is on an axis normal to the axis of the output shaft 37. The shaft 42 has a forward or front end section which is engaged with and carries a manually engageable crank 43, which crank is freely manually accessible at the front of the cabinet.

The right hand ends of the output shaft 37 within that compartment are rotatably supported by bearings 44 and 45 carried by a chassis 46. The chassis is a unitary or fabricated sheet metal unit suitably mounted within the compartment Y of the cabinet A.

In the preferred carrying out of the invention, the crank 43 at the forward end of the input shaft 42 occurs within a forwardly opening recess 47 in the front wall 12 of the cabinet where it is manually accessible, yet is shielded and/or protected so that it cannot be damaged or cause damage.

The recess 47 is defined by a forwardly opening box-like receptacle 47' mounted in and opening in the front wall 12 and has a flat vertical rear wall with an opening 48 to accommodate and rotatably support the forward end portion of the shaft 42 and/or a portion of the crank 43 related to that shaft.

With the drive means D thus far described, it will be apparent that when the crank 43 is manually turned in a clockwise direction, the worm gear 41 on the input shaft 42 turns the driven gear 42 and output shaft 37 and the output shaft 37 turns the drive gear 36 on that shaft in a counter-clockwise direction. Such turning of the drive gear 36, which gear engages the rack 35 of the stop post 30, moves the post 30 down to disengage and effect discharge of the uppermost or top newspaper N of the stack of newspapers in the machine, as described in the foregoing.

In practice, to prevent reverse manual operation of the drive means D, the shaft 42 is divided between the crank 43 and worm gear 41 and the resulting front and rear sections thereof are coupled by an anti-reverse clutch 50 which breaks or interrupts driving engagement with and between the shaft section when the crank is rotated counter-clockwise. The clutch 50 can be any type and/or form of clutch suitable for engagement with and between a pair of aligned shaft sections and is, for the purpose of this disclosure, shown as a simple, small and compact jaw clutch unit of that general type or class of clutch commonly used in small, light duty machines.

In the carrying out of this invention, to prevent overloading and/or forcing of the drive means D, and other yet to be described parts of our machine, an overload clutch 51 is provided between the crank 43 and the anti-reverse clutch 50. The overload clutch 51 is shown as a simple collet-type friction clutch means formed integrally with the crank 43. The clutch 51 comprises an elongate tubular hub 52 on the crank 43 and in which the forward end portion of the shaft 42 is slidably engaged. The rear end portion of the hub has circumferentially spaced longitudinally extending slots. A screw actuated clamp band 53 is engaged about the slotted portion of the hub. The clamp band is adapted to be tightened to establish desired and effective yet safe frictional driving engagement between the crank and the shaft. In the form of the invention illustrated, the hub 52 on the crank and in which the forward portion of the shaft 42 is engaged projects rearwardly from the crank and through the opening 48 in the receptacle 47 and rests on the bottom edge of the opening 48, to support the forward end of the shaft for free rotation.

In practice, when the supply of newspapers N in the machine M is replenished, the stop post 30, which has been moved down in the machine in the course of prior operation thereof, must be raised or elevated to engage the newly deposited newspapers. Since the anti-reverse clutch 50 of the drive means D prevents reverse operation of the means D and resulting lowering of the stop post 30 by operation of the crank 43, supplemental means must be provided to allow for manual lifting and/or elevation of the stop post during loading or replenishing of the supply of newspapers in the machine. One supplemental means for allowing for free manual elevation of the stop post 30 is the provision of a jaw clutch 50', similar to the clutch 50, in the output shaft 37, between the gears 36 and 40, as shown in dotted lines in FIG. 3 of the drawings. Such a clutch maintains effective drive in and through the means D to effect lowering of the post 30 during normal operation of the machine yet allows for the post 30 to be manually engaged and moved upwardly when such is required, without requiring any special work to be performed on or by the drive means D.

Another supplemental means to allow for free manual elevating of the stop post 30 is the provision or inclusion of a vertical shiftable mounting plate 55 for the bearing 45 which supports the rear end of the input shaft 42. The vertical shiftable plate 55 permits the rear end of the shaft 42 to be manually elevated and the worm gear 41 to be moved upwardly and out of engagement with the gear 40. When the gears 40 and 41 are disengaged in the manner noted above, the stop post 30 can be manually engaged and elevated, as circumstances require.

The plate 55, as shown in FIG. 6 of the drawings, is a flat vertical plate on which the bearing 45 is suitably fixed. The plate 55 has a pair of laterally spaced vertically extending slots 56 and is retained in vertical shiftable sliding engagement on the forwardly disposed surface of a vertical panel portion of the chassis 46 by a pair of headed fasteners 57 engaged through the slots and into the said panel portion of the chassis.

While the last noted means for disengaging the worm gear 41 from the gear 40 is simple and may be a bit less expensive than the previously noted clutch 50', it is less convenient than the clutch 50' since the operator of the machine must, in the absence of other calibrated means to relatively hold the plate 55 up, manually engage and elevate the shaft 42 with one hand and simultaneously manually engage and elevate the stop post 30 with his other hand, to effect resetting of the post in desired vertical position.

In addition to the foregoing, our new machine L includes releasable latch means L which is normally set to lock the input shaft 42 against rotation. The means L is preferably operated by coins deposited in the machine to release and allow the shaft 42 to rotate. Further, the means L is preferably such that it is reset to lock the shaft by a newspaper advancing forwardly and downwardly from position above the support plate P.

In the form of the invention shown, the latch means L includes a cog wheel 60 on the input shaft 42 between the worm gear 41 and clutch 50, an elongate normally substantially horizontally disposed latch arm 61 pivotally mounted on the chassis 46 to extend below and to normally engage a cog 62 on the cog wheel 60 and to thereby lock the cog wheel and the shaft 42 against rotation.

In the form of our invention illustrated and as best shown in FIGS. 4, 6, 7 and 8 of the drawings, the cog wheel 60 has four circumferentially spaced radially outwardly projecting cogs 62. The latch arm 61 extends beneath the wheel 60 and has a vertical opening 63 between its ends to releasably receive each cog 62 as it is moved to the bottom of and projects downwardly from the wheel. The arm 61 is pivotally supported at one end portion, remote from the opening 63, by a mounting bracket and pivot pin assembly 64, for free pivotal movement and raising and lowering of its other or free end and for vertical movement of its portion in which the opening 63 occurs for mounting of the arm into and out of latched engagement with the cogs 62 on the wheel 60. The mounting bracket and pivot pin assembly 64 is suitably fixed to a portion of the chassis 46 in the compartment Y which extends horizontally below the drive means D. The free end of the latch arm 61 is normally engaged, urged and held up in a set or latched position by the vertically extending inner end portion of an elongate longitudinally shiftable flexible cable C. The inner free end of the cable C engages the lower side of the free end of the arm. The cable C extends through the cabinet A from adjacent the arm 61 to the upper end of the stop post 30 of the stop means S where its other or outer free end projects vertically upwardly to engage a normally forwardly and downwardly projecting newspaper actuated trigger 65. The trigger 65 is pivotally mounted at the upper end of the stop post 30 for free pivotal movement from said normal forwardly and downwardly projecting position to a substantially horizontal or forwardly and upwardly projecting actuated position.

In accordance with common practice, the cable C extends freely through an elongate flexible tubular sheath 66. The sheath 66 has elongate rigid guide and mounting tubes 67 at its opposite ends. The tubes 67 slidably receive and guide straight rigid drive rods 68 at the ends of the cable. The rods 68 are simply work-engaging extensions and are commonly considered to be integral parts of and are referred to as ends of their related cables.

The mounting tube 67 at the inner end of the cable sheath 66 extends vertically through an opening in the chassis 46, below the free end of the latch arm 61 and is secured or fixed to the chassis by those fastening means provided on and with the tube by the manufacture of the cable or by any other suitable fastening means one might elect to use. The drive rods 68 defining the inner end of the cable C project up from the tube 67 and engages the arm 61 substantially as shown.

The outer end portion of the sheath 66 enters the lower end of the tubular stop post 30 and extends upwardly through that post to the upper end portion thereof. The mounting tube 67 at the outer end of the sheath is anchored or secured within the post 30 by a suitable bracket 69 with the rod 68 related to it projecting freely upwardly from the upper end of the post 30.

The trigger 65 overlies the upper end of the post and has a rear end or edge pivotally coupled with the bracket 69, as shown in FIG. 4 of the drawings.

In operation, when the outer rod 68 or other end of the cable C is urged down by the trigger 65, the inner end of the cable moves up and urges the latch arm 61 up to its set position. When the free end of the latch arm 61 is urged down from its up or set position, the cable C is shifted longitudinally outwardly and its outer end moves up and engages and moves or pivots the trigger 65 up from its normal down position to an up or actuated position.

There is insufficient friction between the cable C and the sheath 66 and insufficient friction at the pivotal mounting means for the arm 61 and trigger 65 to prevent free axial movement of the cable and pivotal movement of the arm and trigger, yet there is sufficient friction between said parts so that when the parts are moved from one position to another, they will remain in set position if not acted upon by some externally applied force.

In addition to the above, the free end of the latch 61 is provided with a flat substantially upwardly disposed striker plate 70 on which a coin Q, such as a quarter, can be dropped or otherwise deposited to move the arm from its normal up and set position to its down or released position. Further, the other or pivotally mounted end of the latch arm 61 is provided with a counter balance weight W which is preferably adjustable and is such that the latch arm can be balanced so that the weight of the free end thereof is insufficient to pivot or move the free end of the arm 61 down and move the cable C longitudinally outwardly, but is such that if and when the striker plate 70 is struck by and the weight of a coin Q is applied thereto, the free end of the arm 61 will move down and shift the cable longitudinally outwardly, as desired.

In practice, the arm 61 is balanced so that the weight of a single coin Q is sufficient to move the arm and cable as described above. However, in practice, there is likely to be sufficient friction between the arm and a related cog 62 of the cog wheel 60 to hold and stop desired movement of the parts. Accordingly, it is desirable that the plate 70 be a striker plate onto which a coin is dropped so that the mass inertia of the coin, upon striking the plate 70, will drive the plate 70 down with sufficient force to break any frictional hold that might occur between the arm 61 and a related cog 62.

The plate 70 is inclined so that after a coin is dropped into engagement thereon and the free end of the arm 61 is pivoted down, any coin that might have come to rest thereon will slide off or from engagement on the plate.

It is believed to be obvious that the cog wheel 60 can be replaced by a simple spur gear and that the cog receiving opening 63 in the latch arm 61 can be replaced by a simple metal gear-engaging tab or pawl carried by the arm 61, without departing from the spirit of our invention. Further, the cog receiving opening 63, or the substitute gear engaging pawl, need not be located between the ends of the latch arm 61, but can be located longitudinally outward from the pivotal axis of the arm wherever sufficient movement for effecting latching and unlatching can be attained. Further, the latch arm 61 can be arranged above or to one side of the cog wheel 60 or substitute gear, rather than below the wheel or gear, if such is desired, without departing from the spirit of our invention.

The above noted variations of our construction are but examples of the sort or kind of variation that can be made without resorting to invention and which any mechanic skilled in the art to which our invention related might make as a matter of choice.

With the construction thus far described, it will be apparent that when a coin is dropped into engagement with the striker plate 70, the arm 61 is moved down from its up, set or locked position and the drive means D is unlocked. Concurrent with the above, the trigger 65 is pivoted up to its up or actuated position. Thereafter, the crank 43 of the means D can be freely rotated to move the stop post 30 down. When the post 30 is moved down a sufficient distance to disengage the top or uppermost newspaper N above the plate P, that paper slides down and forwardly over the upper end of the post and in doing so, engages and urges the trigger 65 down. Downward movement of the trigger 65 moves the cable C axially to urge and move the latch arm 61 up and back to its normal set position where the drive means D is again locked.

It will be apparent from the above that the machine is normally locked and its operation is prevented by the latch means L. The machine is unlocked by a coin moved into engagement with the latch means L. When unlocked, the machine can be manually operated to that extent necessary to effect the discharge of the top or uppermost newspaper N stored in the machine. Finally, the single newspaper discharged from the machine relocks the machine to prevent further operation thereof and discharge of another newspaper until another coin is moved into engagement with the latch means to effect recycling of the machine in the manner set forth above.

It is important to note that the latch means L is unlocked by a coin and is relocked by a dispensed or discharged newspaper. Accordingly, operation of the machine is unaffected by the size or thickness of the newspaper and is such that when once put into operation, it will operate until a newspaper is dispensed. Therefore, if circumstances required, the machine could effectively dispense a stack of folded newspaper of different thickness, one at a time without requiring any adjustments to be made.

Finally, the vending machine that we provide includes a coin mechanism M to receive those coins required for the purchase of a newspaper and which operates to deliver those coins to the latch means L, to effect operation of the machine in the manner described in the foregoing.

The coin mechanism O can be any one of the many standard or common commercially available coin mechanisms for vending machines which the prior art provides and which are such that when required coinage is deposited therein, they operate or can be operated to release and deposit the coin into the machine.

In the form of the invention illustrated, we have elected to show one simple form of coin mechanism O which is believed to be notably less costly than conventional and commercial coin mechanisms and which is effective in carrying out our invention.

The coin mechanism O includes a slotted coin receiving fitting 75 mounted in an opening in the front wall 12 of the cabinet A (above the drive means D and the latch means L within the cabinet). The mechanism O next includes an elongate rearwardly and downwardly inclined trough-like coin discriminator 76 having an upper forward coin-receiving end communicating with the fitting 75. The elongate inclined trough-like discriminator has one or more openings or slots 77 through which coins of improper or wrong denomination and size will move to drop from the discriminator and advance into a coin return chute 78, opening at the front wall 12 of the cabinet. The discriminator has an open lower rear end through which coins of desired or proper denomination and size advance and which communicates with the open upper end of a vertical coin delivery duct 79 which delivers proper coins to the upwardly and longitudinally outwardly opening receiving channel 80 extending longitudinally of one end portion of the elongate normally substantially horizontal arm 81 of the balance scales S. The plate 80 of the balance scale S is arranged below the discharge end of the duct 79. The balance scale S is balanced so that the end of the arm 81, to which deposited coins in the channel 80 advance and are stopped, is normally in an up position and is such that when a proper coin or predetermined weight of coins is deposited by the duct 78 into the channel 80, the arm is moved down and the coins in the channel 80 are released and permitted to advance longitudinally outward in the channel from the arm. The means M next includes a transfer chute 82 with an open upper end positioned below the free end of the arm and open end of the channel 80 of the scale S to receive those coins which move from within the channel 80 when the scale is tipped and which has a lower discharge end which occurs above the striker plate 70 of the latch means L, whereby coins delivered by the scale S drop onto the striker plate and actuate the latch means L, as noted in the foregoing.

Finally, the means O includes a vertical coin duct 83 with an upper open end below and receiving those coins which strike the striker plate 70 of the means L and which extends to and communicates with a coin collection box 84 in the cabinet below the latch means L. The box 84 is shown formed in part by the front wall 12 of the cabinet A and the chassis 46 therein and has a key locked access closure 85 in the wall 12, for easy access to the coins collected during servicing of the machine.

The balance scale S is preferably provided with an adjustable balance weight W at the end of the arm 81 remote from the channel 80, which weight can be easily and quickly moved so that the scale will only operate to deliver coins to the transfer chute 82 when a predetermined size coin and/or a predetermined weight of predetermined size coins is deposited in the channel 80 in the arm.

In the machine that we have made, the coin mechanism is such that it will only accept quarters and is such that when the weight W is in one of two positions, one quarter will effect operation of the machine and when the weight W is in the other of said two positions, it is necessary that three quarters be deposited in the machine to effets its operation. Accordingly, our new coin operated newspaper vending machine can be operated to sell or vend weekday issues of a newspaper which sell for 25 cents and can be adjusted by simply moving the weight W from one of its positions to the other to sell or vend Sunday issues of the newspaper which are intended to sell for 75 cents.

It will be apparent that by simply changing or increasing the number of positions to which the weight W can be moved, the machine can be made to vend and sell newspapers for 50 cents, a dollar, or any multiple of 25 cents, without requiring that coins other than quarters be used.

Figures 9, 10, 11:
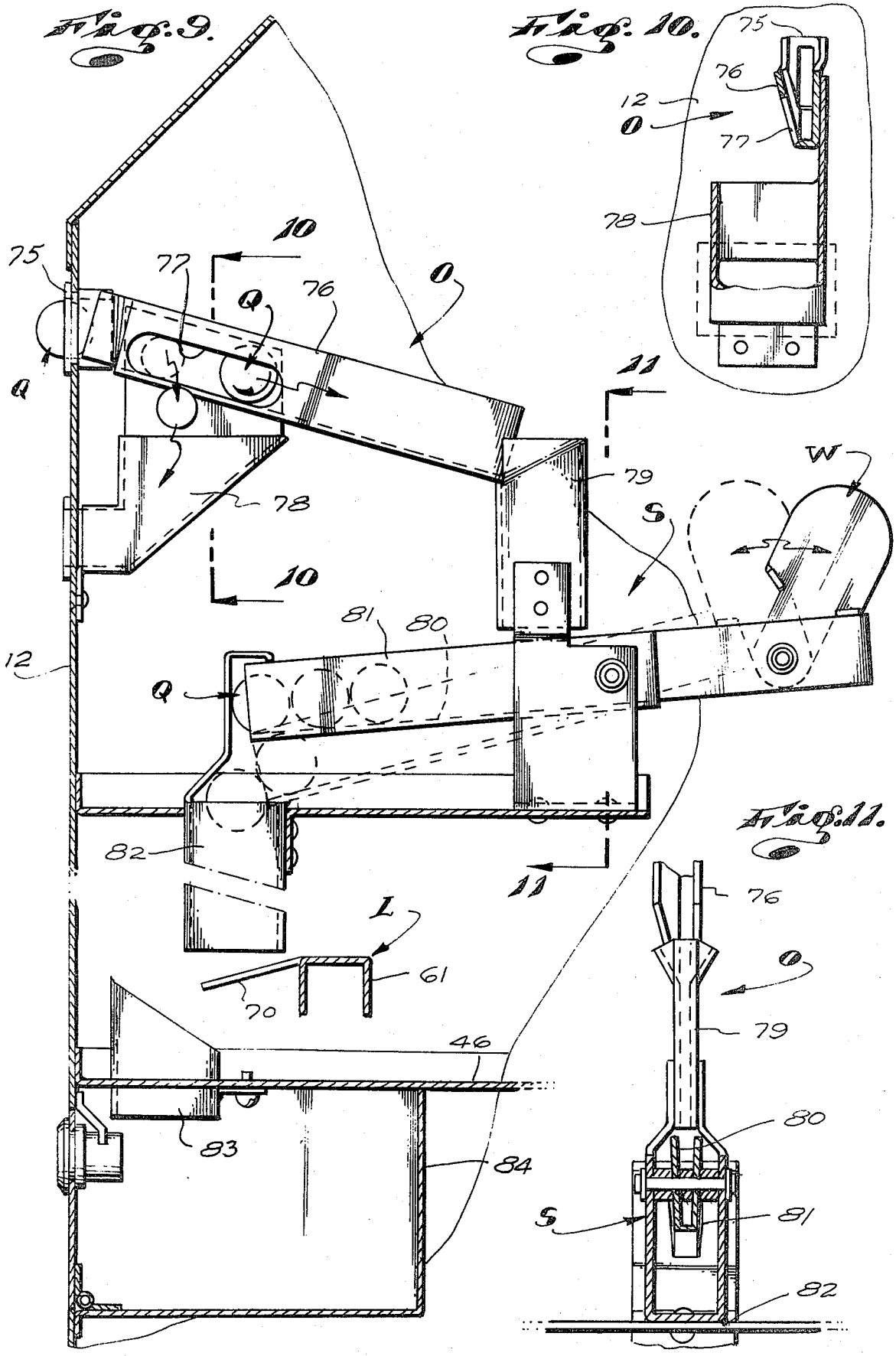
FIG. 9 is a view of our coin mechanism.
FIG. 10 is a view taken as indicated by line 10—10 in FIG. 9.
FIG. 11 is a view taken as indicated by line 11—11 in FIG. 9.

Since the coin mechanism O and those other parts of our construction which are provided to handle coins deposited in the machine are essentially independent of the means L and D, we have elected to illustrate the means L separately in FIGS. 9, 10 and 11 of the drawings (without regard to scale) with only the striker plate 70 of the means L related thereto, to show that relationship between the means O and L which is required for the effective operation of the machine. Further, since the means O is a rather simple structure which can be fabricated of various materials and be presented in notably different appearing forms, it is shown in a rather diagrammatic manner, with minimum attention given to details of construction or to the manner in which its parts are mounted within the cabinet.

Having described only one typical preferred form and application of our invention, we do not wish to be limited to the specific details herein set forth, but wish to reserve to ourselves any modifications and/or variations that may appear to those skilled in the art and which fall within the scope of the following claims.

Having described our invention, we claim:

1. A coin-operated newspaper vending machine comprising an elongate vertical cabinet with top and bottom ends, laterally spaced vertical sides, a vertical back and a vertical front wall spaced forward from said back, a flat, smooth, forwardly and upwardly disposed newspaper support plate within the cabinet and having a lower forward edge spaced rearward from the front wall and inclined forwardly and downwardly at an angle at which a newspaper supported in flat engagement atop the plate and newspapers in stacked engagement above the plate will slide forwardly and downwardly from engagement with each other and from the plate, a discharge opening in the front wall below the support plate and a panel spaced rearward of the front wall and below the support plate to direct newspapers moving forwardly and downwardly from the support plate to said discharge opening, stop means releasably engaging the lower forward edges of newspapers above the support plate and including an elongate vertical stop post spaced rearward from the front wall and having an upper portion engaging the lower forward edges of said newspapers, manually operable drive means intermittently operable to move the stop post down to disengage the uppermost newspaper above the support plate, latch means releasably locking the drive means and including a trigger disposed in the path of newspapers moved forwardly and downwardly from above the plate, a stop part in said drive means, a movable latch part shiftable into and out of engagement with the stop part, means between the trigger and the latch part to move the latch part into stopped engagement with the stop part when the trigger is moved in advance of a newspaper, and a coin mechanism with a coin-receiving slot accessible at the front of the cabinet and operable to receive and to release predetermined coinage deposited in the machine and to engage and move the latch part out of engagement with the stop part.

2. The coin-operated newspaper vending machine set forth in claim 1 wherein the drive means includes a rack on the stop part, a drive gear engaging the rack, a driven shaft carrying the drive gear, a manually engageable crank accessible at the exterior of the cabinet and a drive train between the crank and the driven shaft.

3. The coin-operated newspaper vending machine set forth in claim 2 wherein said drive train includes a drive shaft carrying said crank, a driven gear on the driven shaft and a worm gear on the drive shaft engaging the driven gear.

4. The coin-operated newspaper vending machine set forth in claim 3 wherein the drive shaft is sectional, the crank is carried by one section of the drive shaft, the worm gear is carried by the other section of the drive shaft and wherein the drive shaft sections are coupled by an anti-reverse clutch unit which establishes driving engagement between the drive shaft sections when the drive train is driven to lower the stop post.

5. The coin-operated newspaper vending machine set forth in claim 4 wherein said lock part is on one of said shafts and rotates therewith, said movable latch is pivotally mounted in the machine adjacent the lock part and has a first portion movable into and out of engagement with the lock part and a second portion coupled with the trigger and engaged with said coin mechanism.

6. The coin-operated newspaper vending machine set forth in claim 5 wherein the movable latch and trigger are coupled by an elongated, flexible axially shiftable drive cable.

7. The coin-operated newspaper vending machine set forth in claim 6 wherein said second portion of the latch is engaged with the coin mechanism in the batch of coins introduced into said mechanism and released thereby into the machine.

8. A newspaper vending machine comprising an elongate vertical cabinet with a front wall, a flat, smooth forwardly and upwardly disposed newspaper support plate within the cabinet and disposed at an angle at which a newspaper supported thereon and newspapers in stacked engagement thereabove will slide forwardly and downwardly from engagement with each other and from the plate, a discharge opening in the front wall below the support plate and a panel spaced rearward from the front wall and below the support plate to direct newspaper moving forwardly and downwardly from the support plate to said discharge opening, stop means releasably engaging the lower forward edges of newspapers above the support plate and including a vertical stop post with an upper portion engaging the forward edges of said newspapers, a manually operable drive means intermittently operable to move the stop post down to disengage the uppermost newspaper above the support plate and including a manually engageable drive part accessible at the exterior of the cabinet and a drive train within the cabinet between said drive part and the stop post and operating to move said stop post down when said drive part is manually moved, releasable latch means in said drive train to normally stop operation thereof and a coin mechanism in the cabinet with a coin receiving opening accessible at the exterior of the cabinet and operating to release the latch means when predetermined coinage is received thereby, said releasable latch means includes a movable part arranged in the path of newspapers moving forward and down from above the support plate and operating to set the latch means to stop operation of the drive train when engaged and moved by a newspaper advancing forwardly and downwardly from above the stop plate.

* * * * *